US005829451A

United States Patent [19]

Barber

[11] Patent Number: 5,829,451

[45] Date of Patent: Nov. 3, 1998

[54] CIGAR HUMIDOR

[76] Inventor: Michael Barber, 20 S. Ridge Rd., Pomona, N.Y. 10970

[21] Appl. No.: 897,785

[22] Filed: Jul. 21, 1997

[51] Int. Cl.[6] ..... A24F 13/24

[52] U.S. Cl. ..... 131/250; 131/328; 131/329; 312/31

[58] Field of Search ..... 131/329, 328, 131/250, 300; 312/31, 231, 229; 454/230; 206/213.1, 213

[56] References Cited

U.S. PATENT DOCUMENTS 1,054,159 2/1913 Wilson ..... 131/300
3,023,064 2/1962 Sosa ..... 131/300
3,885,843 5/1975 Rubel ..... 312/31
4,054,146 10/1977 Ortiz, Jr. ..... 131/170
5,607,051 3/1997 Espinosa ..... 206/213.1

*Primary Examiner*—John G. Weiss
*Assistant Examiner*—Charles W. Anderson
*Attorney, Agent, or Firm*—Bryan, Levitin & Bab, LLP

[57] ABSTRACT

A cigar humidor has a liner and is for containing tobacco products. The liner is made of liner members of humidor wood and has an increased interior surface area for being exposed to an interior of the humidor.

17 Claims, 3 Drawing Sheets

CIGAR HUMIDOR

FIELD AND BACKGROUND OF THE INVENTION

The present invention relates, in general, to humidors, and in particular to a new and useful cigar humidor which improves the qualities imparted by humidors to cigars contained therein.

Although an important function of a humidor is to safely store tobacco products, in particular cigars, an equally important function of the humidor is to provide an appropriate environment which preserves the cigars and which can actually improve the quality of the cigars over time.

Humidors are generally in the form of a rectangular wooden box with a wooden lining. The wooden lining has only a relatively small surface area exposed to the interior volume of the box. The job of a conventional humidor is to maintain a relative humidity of about 65 to 75 percent within the humidor. Another objective is to impart a woody seasoned taste to the tobacco products in the humidor. This is achieved both by establishing the moist interior environment and by selecting the appropriate wood for the humidor lining which has a sap that evaporates to add flavor to the cigars. This serves to preserve, age and add flavor to the cigars or other tobacco products stored within the humidor.

Some examples of humidor structures can be found in the prior art. U.S. Patent Des. 372,138 discloses a cigar humidor storage cabinet design. U.S. Pat. No. 4,534,369 discloses an enclosure which forms a humidor for tobacco products.

Also see U.S. Pat. No. 5,607,051 for a humidor having multiple storage compartments. U.S. Pat. No. 5,011,009 discloses a cigar storage and transportation container which has a humidor function. U.S. Pat. No. 4,008,930 also discloses a humidor for tobacco products which creates an airtight compartment and has a removable closure.

SUMMARY OF THE INVENTION

An object of the present invention is to improve the relationship between a tobacco product, in particular cigars, and its temporary home in the form of a specially designed and constructed humidor.

A further object of the present invention is to increase the interior surface area of the humidor liner without increasing the size of the humidor box, thus increasing the rate of humidification and circulation of air within the humidor to improve flavor and aging for the tobacco product.

According to the present invention, the total interior surface area is increased by at least 25 percent. This increases the distribution of humidity throughout the enclosure and along the full vertical height of the enclosure.

The present invention utilizes an appropriate humidor lining material, such as Spanish cedar. The invention is not limited to using Spanish cedar, however, and any appropriate humidor lining wood can be used in accordance with the present invention.

Various techniques are used to increase the surface area of the wood lining in the humidor. These include grooving the interior surfaces of the wood lining, drilling holes in the wood lining, piecing together strips of lining material of different widths to produce a grooved surface, and combinations of the foregoing techniques.

The increase of surface area increases the interaction between the moisture in the humidor, sap from the liner which evaporates from the wood and imparts flavor to the tobacco product, and the circulation of air within the humidor.

A further object of the present invention is to provide a humidor method and apparatus which increases the beneficial effects of storing tobacco products in the humidor and which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
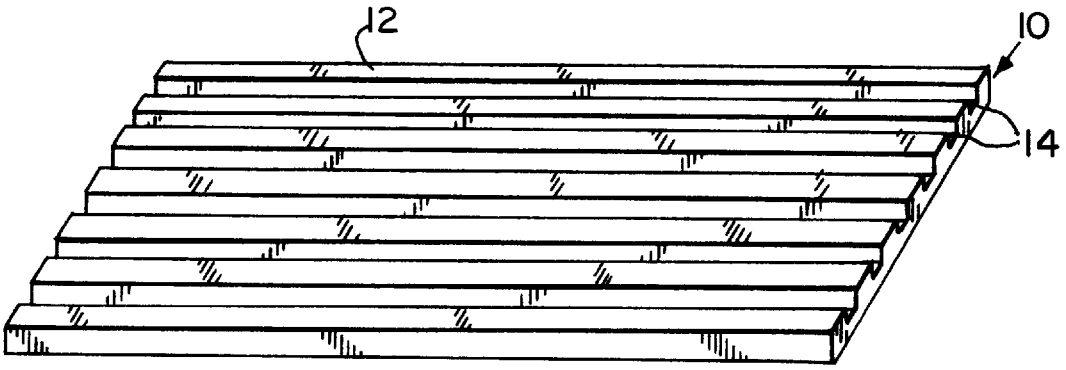
FIG. 1 is a schematic perspective view of a humidor liner panel in accordance with the present invention which can be used as a sidewall, a bottom wall or a top wall of the humidor container.

Referring to the drawings in particular, the invention embodied in FIG. 1 is a humidor liner panel generally designated 10, made of appropriate humidor wood such as Spanish cedar or other wood having a high flavorful sap content which is known for use in tobacco product humidors.

Although conventional liners have flat smooth surfaces facing the interior of the humidor, according to the present invention, the interior surface 12 of liner 10 contains a plurality of grooves 14 which are parallel to each other and across the length dimension of the liner. Advantageously, the liner is approximately ¼ inch thick and has a width of about 3½ inches and a length of about 9 inches. Each groove 14 has an ⅛ inch width and ⅛ inch depth.

In accordance with the present invention, providing six such grooves equally spaced across the 3½ inch width of the liner 10, increases the effective surface area of the wood from 31½ square inches to 45 square inches. This represents an increase in surface area of about 40 to 45 percent, and a corresponding increase in the beneficial effects of the specialized humidor liner. Not only is the surface area increased for increasing the evaporation of flavorful chemicals into the atmosphere of the humidor, but also the grooves provide additional circulation opportunities for the atmosphere.

Figure 2:
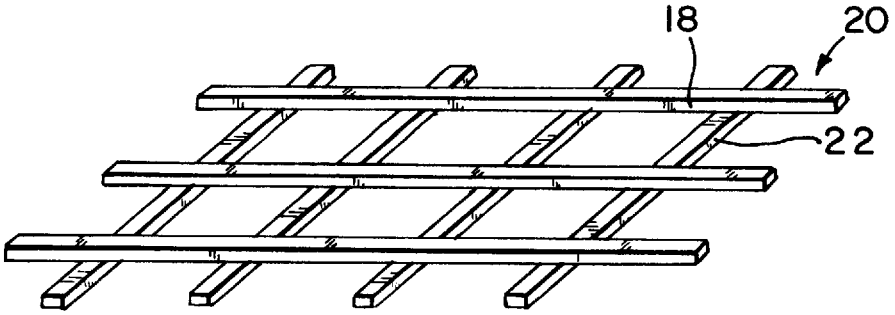
FIG. 2 is a perspective view of a lattice which can be used over a liner floor according to the present invention.

FIG. 2 illustrates a lattice generally designated 20, made of crossing parallel cedar strips 18 and 22 which are fastened to each other by adhesive or other appropriate means which do not adversely effect the atmosphere in the humidor. Preferably, the cedar strips are ⅜ inch by ⅜ inch square strips and extend the full width and length of liner 10. Liner 10 of FIG. 1 can be used for the sidewalls, roof and/or floor of the humidor box. Lattice 20 is advantageously placed over the floor and the cigars or other tobacco products rest on the lattice. This further increases the circulation within the humidor.

Figure 3:
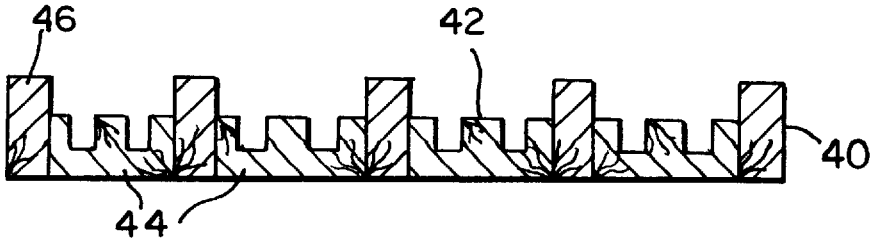
FIG. 3 is a side sectional view of another embodiment of the liner in accordance with the present invention.

FIG. 3 illustrates another embodiment of the invention which increases the surface area of a liner generally designated 40, on the interior surface 42, by piecing together the liner of grooved pieces 44 which are connected between taller strips 46 and to produce a highly grooved upper surface 42. Although separate pieces are shown connected to each other to form liner 40, liner 40 can also be made of one piece of humidor liner wood which is cut to form the grooved pattern.

Figure 4:
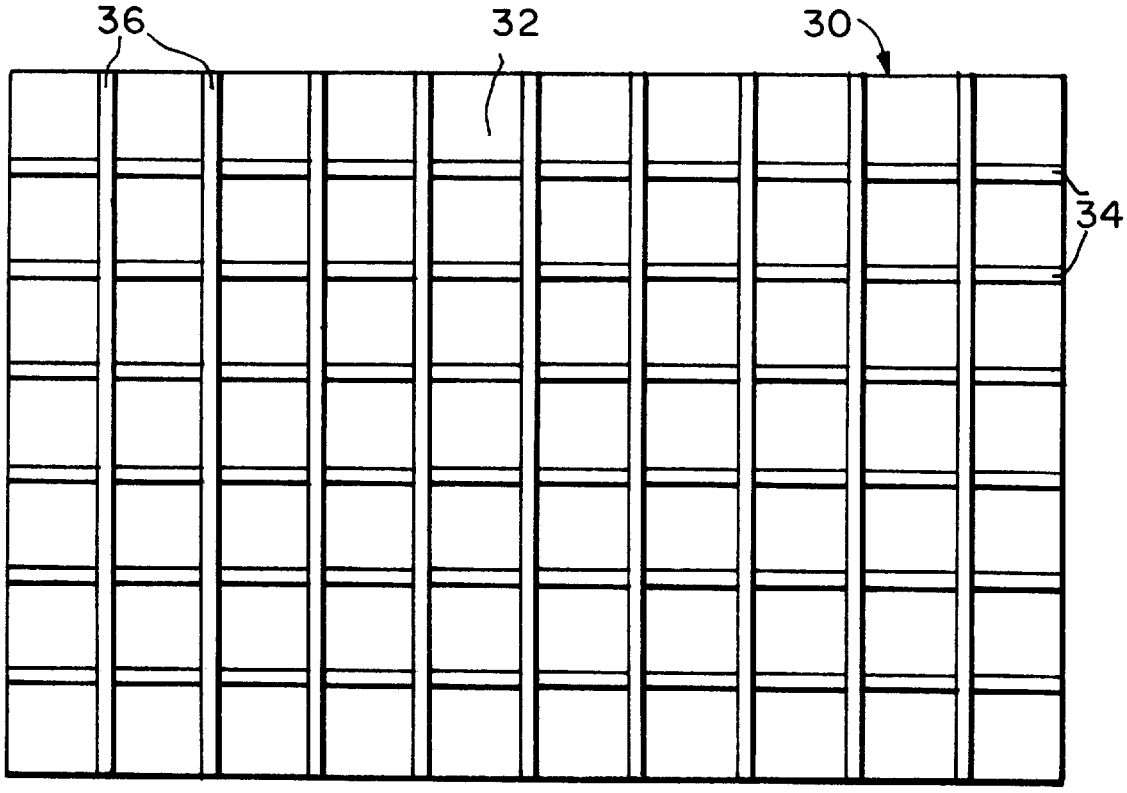
FIG. 4 is a top plan view of another embodiment of the liner.

FIG. 4 illustrates another embodiment of the invention where a sidewall, floor or ceiling liner generally designated 30 has an upper surface 32 with parallel shallow grooves 34 which cross parallel deep grooves 36. Shallow grooves 34 can be, for example, 1/8 inch by 1/8 inch in cross section while deep grooves 36 can be 1/8 inch wide and 3/16 inch deep. This further increases the surface area and the opportunity for air circulation.

Figure 5:
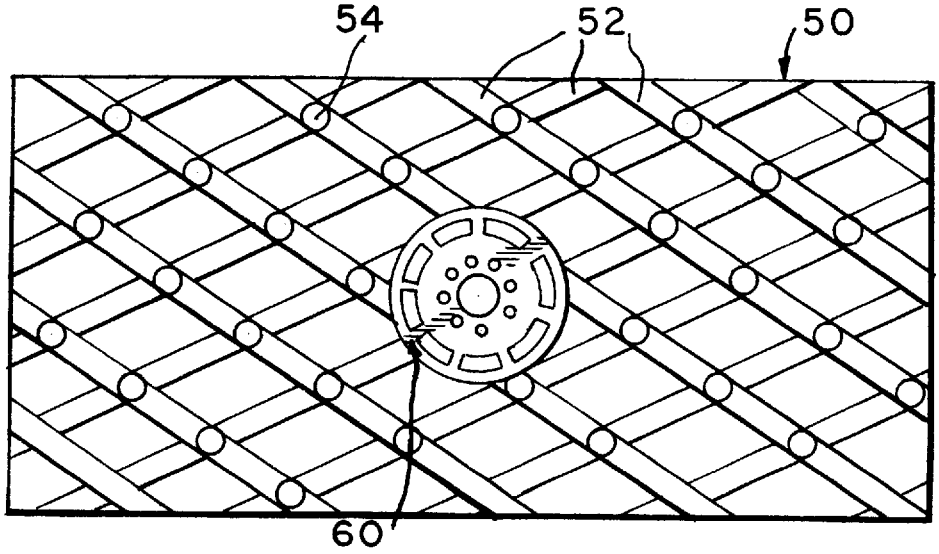
FIG. 5 is a top plan view of an example of a roof or ceiling liner for a humidor according to the present invention.

FIG. 5 illustrates another embodiment of a humidor liner used, for example, as the ceiling or roof for the humidor container or box. The liner generally designated 50 contains a diamond pattern of crossing grooves 52 which may be of the same depth or deep and shallow as with the embodiment of FIG. 4. To further increase surface area and also to provide air circulation to the wood of the humidor box which is underneath liner 50 and itself may be of Spain cedar, holes 54 are drilled at the intersections of grooves 52.

FIG. 5 also illustrates a conventional humidity element 60 which is generally fastened to the interior surface of the ceiling liner and contains a porous member which absorbs or is saturated with water. Humidifying element 60 is generally in the form of a cylindrical metal cup having holes facing the interior of the humidor box for allowing a slow flow of humidor air from the saturated member into the interior of the humidor.

Figure 6:
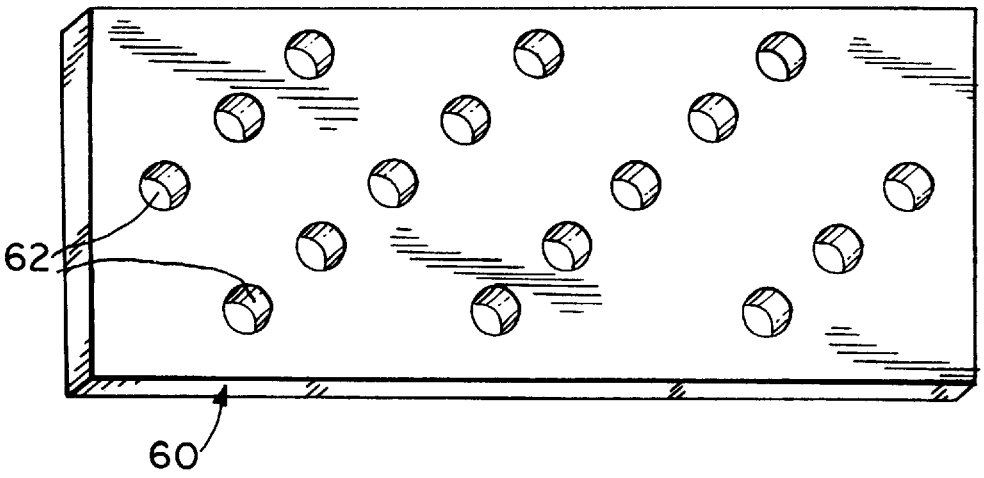
FIG. 6 is a perspective view of another embodiment of the liner in accordance with the present invention.

FIG. 6 illustrates another embodiment of the liner generally designated 60 which contains a pattern of through holes 62. As with the other embodiments of the invention, this increases surface area for the wood of the liner 60 and also provides access to the wood of the humidor box.

Figure 7:
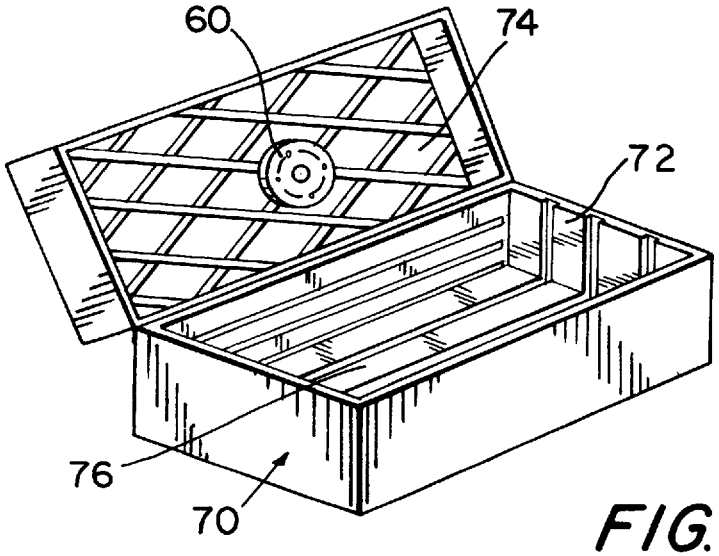
FIG. 7 is a perspective view of a humidor container with liners according to the present invention.

As shown in FIG. 7, a humidor box generally designated 70 may be made of Spanish cedar or other appropriate wood and contains side liners 72, a ceiling liner 74 and a floor liner 76, all constructed in accordance with the present invention. Wood of liners 72, 74 and 76 may also be Spanish cedar or other appropriate flavorful wood which imparts appropriate characteristics to the aging tobacco products within the humidor box 70. Where humidor wood is used as the box 70 or as a further interior lining of box 70, liners 72, 74 and 76 of the present invention may contain holes such as those shown in embodiments of FIGS. 5 and 6, to allow the beneficial vapors from the woods to enter into the interior of the humidor box.

While a specific embodiment of the invention has been shown and described in detail to illustrate the application of the principles of the invention, it will be understood that the invention may be embodied otherwise without departing from such principles.

What is claimed is:

1. A method for improving the relationship between tobacco products in a humidor and a humidor liner, the method, comprising providing grooves on an interior surface of the humidor liner for increasing the surface area of wood forming the humidor liner exposed to the interior of the humidor.

2. A method according to claim 1 wherein the grooves cross each other in a checkerboard pattern.

3. A method according to claim 1 wherein the grooves cross each other in diamond pattern.

4. A method according to claim 1 including providing holes through the humidor liner.

5. A method according to claim 4 wherein the holes are provided at intersections between crossing grooves in the humidor liner.

6. A liner for a humidor for containing tobacco products, the liner comprising:

a liner member made of humidor wood and having an interior surface exposed to an interior of the humidor, the interior surface formed by at least two different surface levels providing an increased surface area to the liner member.

7. A liner according to claim 6, wherein the at least two surface levels comprise a first plurality of grooves cut into the interior surface of the liner member.

8. A liner according to claim 7, wherein the at least two surface levels further comprise a second plurality of grooves which cross the first plurality of grooves to form intersections on the interior surface of the liner member.

9. A liner according to claim 8, including through-holes cut through the liner member and located at at least some of the intersections.

10. A liner according to claim 6, wherein the at least two levels comprise a plurality of grooves cut into the interior surface of the liner member, some of the grooves having one depth and others of the grooves having a second, different depth.

11. A liner according to claim 10, wherein the grooves of the one depth are across the grooves of the second depth.

12. A liner according to claim 11, wherein the grooves are each parallel to one edge of the liner member.

13. A liner according to claim 6, wherein the at least two levels comprise crossing grooves forming a diamond pattern on the interior surface of the humidor liner.

14. A liner according to claim 13, including holes cut through the liner mender at at least some intersections between grooves in the diamond pattern.

15. A liner according to claim 6, wherein the liner member is formed from pieces of wood having different widths fastened to each other to form the liner member.

16. A liner according to claim 15, wherein some of the pieces of wood have grooves therein.

17. A liner according to claim 6, including a lattice made of humidor wood for engagement over the liner member for supporting tobacco products.

* * * * *